US011504835B2

(12) United States Patent
Theberath et al.

(10) Patent No.: US 11,504,835 B2
(45) Date of Patent: Nov. 22, 2022

(54) COMPRESSED AIR NAILER WITH SAFETY VALVE ARRANGEMENT

(71) Applicant: Joh. Friedrich Behrens AG, Ahrensburg (DE)

(72) Inventors: Martin Theberath, Tangstedt (DE); Florian Jung, Schoenberg (DE); Joachim Bauer, Bad Oldesloe (DE)

(73) Assignee: Joh. Friedrich Behrens AG, Ahrensburg (DE)

( * ) Notice: Subject to any disclaimer, the term of this patent is extended or adjusted under 35 U.S.C. 154(b) by 0 days.

(21) Appl. No.: 16/760,966

(22) PCT Filed: Sep. 27, 2018

(86) PCT No.: PCT/EP2018/076332
§ 371 (c)(1),
(2) Date: May 1, 2020

(87) PCT Pub. No.: WO2019/086180
PCT Pub. Date: May 9, 2019

(65) Prior Publication Data

US 2020/0306940 A1 Oct. 1, 2020

(30) Foreign Application Priority Data

Nov. 1, 2017 (EP) ..... 17199525

(51) Int. Cl.
*B25C 1/00* (2006.01)
*B25C 1/04* (2006.01)

(52) U.S. Cl.
CPC ..... *B25C 1/008* (2013.01); *B25C 1/043* (2013.01); *B25C 1/042* (2013.01); *B25C 1/046* (2013.01); *B25C 1/047* (2013.01)

(58) Field of Classification Search
CPC ..... B25C 1/008; B25C 1/042; B25C 1/043; B25C 1/046; B25C 1/047
See application file for complete search history.

(56) References Cited

U.S. PATENT DOCUMENTS 3,964,659 A * 6/1976 Eiben ..... B25C 1/043 227/8
5,370,037 A * 12/1994 Bauer ..... B25C 1/042 91/236

(Continued)

FOREIGN PATENT DOCUMENTS

DE 102013106657 A1 1/2015
EP 1666210 A1 6/2006

(Continued)

OTHER PUBLICATIONS

PCT/EP2018/076332; International Filing Date Sep. 27, 2018; International Preliminary Report on Patentability; dated May 14, 2020 (8 pages).

(Continued)

*Primary Examiner* — Joshua G Kotis
(74) *Attorney, Agent, or Firm* — Barclay Damon LLP

(57) ABSTRACT

A compressed air nailer comprises a control line configured to trigger a driving process when a valve pin is displaced relative to a valve sleeve into an actuated position. The valve sleeve is configured to move between a triggering position and a locked position. A switching surface is coupled to at least one of a trigger and a placing sensor and configured to actuate the valve pin. An outer sleeve is configured to guide the valve sleeve. The switching surface is positioned at a switching surface position relative to the outer sleeve when both the trigger and the placing sensor are actuated. The switching surface is configured to displace the valve pin into the actuated position when the valve sleeve is positioned in the triggering position. The switching surface does not (Continued)

displace the valve pin into the actuated position when the valve sleeve is positioned in the locked position.

10 Claims, 7 Drawing Sheets

(56) References Cited

U.S. PATENT DOCUMENTS

| | | | | |
|---|---|---|---|---|
| 5,522,532 | A * | 6/1996 | Chen | B25C 1/008 227/130 |
| 5,785,228 | A | 7/1998 | Fa et al. | |
| 6,857,547 | B1 * | 2/2005 | Lee | B25C 1/008 227/130 |
| 6,860,416 | B1 * | 3/2005 | Chen | B25C 1/008 227/130 |
| 7,308,995 | B2 * | 12/2007 | Uchiyama | B25C 1/043 227/8 |
| 2001/0009260 | A1 | 7/2001 | Ishizawa et al. | |
| 2007/0261546 | A1 * | 11/2007 | Lee | B25C 1/041 91/418 |
| 2009/0302087 | A1 * | 12/2009 | Liang | B25C 1/008 227/130 |
| 2020/0189078 | A1 * | 6/2020 | Theberath | B25C 1/047 |
| 2021/0138621 | A1 * | 5/2021 | Theberath | B25C 1/008 |

FOREIGN PATENT DOCUMENTS

| | | | |
|---|---|---|---|
| EP | 3090836 | A1 | 11/2016 |
| RU | 2518826 | C2 | 10/2014 |
| SU | 537808 | A2 | 12/1976 |
| SU | 537809 | A1 | 12/1976 |
| SU | 629056 | A1 | 10/1978 |
| TW | 201114560 | A | 5/2011 |
| WO | 2016/002540 | A1 | 1/2016 |

OTHER PUBLICATIONS

PCT/EP2018/076332; International Filing Date Sep. 27, 2018; International Search Report and Written Opinion; dated Jan. 4, 2019 (11 pages).

PCT/EP2018/076332; International Filing Date Sep. 27, 2018; English translation of International Search Report; dated Jan. 4, 2019 (2 pages).

TW 107135172; filed Oct. 5, 2018; Taiwan Examination Report; dated Oct. 5, 2021 (4 pages).

TW 107135172; filed Oct. 5, 2018; English Translation of Taiwan Examination Report; dated Oct. 5, 2021 (6 pages).

RU 2020116524/05(027378); filed Sep. 27, 2018; Office Action dated Dec. 24, 2021 (8 pages).

RU 2020116524/05(027378); filed Sep. 27, 2018; English Translation of Office Action dated Dec. 24, 2021 (9 pages).

RU 2020116524/05(027378); filed Sep. 27, 2018;Search Report dated Dec. 23, 2021 (3 pages).

JP 2020-521521; filing date Sep. 27, 2018; Japanese Office Action dated Aug. 30, 2022 (7 pages).

* cited by examiner

COMPRESSED AIR NAILER WITH SAFETY VALVE ARRANGEMENT

CROSS REFERENCE TO RELATED INVENTION

This application is a national stage application pursuant to 35 U.S.C. § 371 of International Application No. PCT/EP2018/076332, filed on Sep. 27, 2018, which claims priority to, and benefit of, European Patent Application No. 17 199 525.1, filed Nov. 1, 2017, the entire contents of which are hereby incorporated by reference.

BACKGROUND

The invention relates to a compressed air nailer that has a trigger, a placing sensor and a trigger valve with a valve pin and valve sleeve. When the valve pin is displaced relative to the valve sleeve into an actuated position, a control line is aerated or deaerated in order to trigger a driving process. The valve pin is actuated by a switching surface which is coupled to the trigger and/or to the placing sensor.

If such a compressed air nailer is placed onto a workpiece, the placing sensor is displaced against the force of the spring until an outlet tool lies on, or nearly on, the workpiece. Only when the placing sensor has been actuated in this manner is a driving process able to be triggered. As a result, relative to devices without a placing sensor, compressed air nailers provide considerably improved safety from unintentional triggering.

Some compressed air nailers of the described kind can be used in two different operating modes: With so-called single triggering, the compressed air nailer is first placed onto a workpiece which actuates the placing sensor. Subsequently, the trigger is actuated manually and, as a result, an individual driving process is triggered. With so-called contact triggering, also denoted as "touching," the user already holds the trigger pressed down while placing the compressed air nailer onto the workpiece. When the workpiece is touched, the placing sensor is actuated and thereby triggers a driving process. The compressed air nailer may be placed repeatedly in rapid succession which permits a very rapid operation, in particular when for sufficient fastening a plurality of fastening means have to be driven in, only low requirements being set for the positional accuracy thereof.

In specific situations, however, an increased risk of injury arises from the contact triggering method. If the user holds the manually actuated trigger pressed down, for example, not only when he wishes to position the compressed air nailer onto one and the same workpiece at a spacing of a few centimeters from the previously driven-in fastening means, but also when he changes to a different workpiece arranged at a distance therefrom, a driving process may be triggered by an unintentional contact of an object or body part with the placing sensor. For example, it may lead to accidents when a user (by ignoring important safety rules) climbs on a ladder with the compressed air nailer, holds the trigger pressed down and unintentionally touches the placing sensor with his leg.

Some known compressed air nailers attempt to reduce this risk associated with the contact triggering mode by contact triggering only being possible for a short time period after actuating the trigger or respectively, after a driving process. If the time period has elapsed, the trigger first has to be released again. An example thereof has been disclosed in the publication EP 2 767 365 B1. The compressed air nailer disclosed therein has a trigger and a placing sensor, in each case a control valve being assigned thereto. Moreover, the known device has a safety control chamber, the pressure thereof acting on a locking piston. In a specific position of the locking piston, the triggering of a driving process is prevented. The safety control chamber is aerated via the control valve assigned to the trigger and a throttle. As a result, after actuating the trigger, contact triggering is only possible until the pressure in the safety control chamber has exceeded a predetermined pressure threshold. Subsequently, the compressed air nailer is locked until the trigger is released and the pressure in the safety control chamber has dropped again below the pressure threshold.

A similar functionality is provided by the compressed air nailer which has been disclosed in U.S. Pat. No. 3,964,659 which may also be used in individual triggering mode and in contact triggering mode and in which a trigger and a placing sensor are coupled together mechanically via a rocker. The rocker acts on a control valve in order to trigger a driving process by deaerating a main control line. If merely the trigger is actuated but not the placing sensor, a control pin of the control valve is only displaced over part of its displacement path. This semi-actuation of the control valve leads to a slow aeration of a control chamber via a small aeration opening. The pressure prevailing in the control chamber acts on a valve sleeve which surrounds the control valve and finally displaces this valve sleeve into a locked position in which a complete actuation of the valve pin is no longer able to deaerate the main control line, so that contact triggering is not possible.

With some known units, initial triggering is only possible in single triggering operation. For the initial driving process, these units must also first be placed onto the workpiece which actuates the placing sensor. A subsequent actuation of the trigger then triggers the first driving process. Subsequently, within a short time period further driving processes may take place by contact triggering, i.e. by repeatedly lifting and placing the device onto the workpiece with the trigger continually actuated. This functionality is disclosed in the compressed air nailer described in the publication DE 10 2013 106 657 A1. To this end, a trigger and a placing sensor are mechanically coupled via a rocker which acts on a control valve in order to trigger a driving process. With each driving process a pressure is built in a control chamber which acts on a mechanical actuating member. The control chamber is slowly deaerated via a deaeration opening. The actuating member reaches a locked position depending on the pressure in the control chamber, whereby a mechanical action of the placing sensor on the rocker is prevented when the trigger is actuated and contact triggering becomes impossible. In an exemplary embodiment shown in one of the cited documents, the mechanical actuating member is a valve sleeve guided in an outer sleeve in which a valve pin of a trigger valve is guided. In the locked position, the valve sleeve holds the valve pin and, along with it, the rocker lying against the valve pin in a position in which the rocker is missed by the placing sensor. Then further triggering is only possible after the trigger is released and the unit has been removed from the workpiece.

Proceeding therefrom, it is the object of the invention to provide a compressed air nailer with an effective, robust and reliable safety mechanism.

BRIEF SUMMARY OF THE INVENTION

An embodiment of a compressed air nailer comprises a working piston which is connected to a driving tappet for driving in a fastening means and which is subjected to compressed air when a driving process is triggered. The compressed air nailer further comprises a trigger valve that has a valve sleeve and a valve pin guided in the valve sleeve. A control line is aerated or deaerated by the trigger valve to trigger a driving process when the valve pin is displaced relative to the valve sleeve into an actuated position. A trigger, a placing sensor as well as a switching surface which is coupled to the trigger and/or to the placing sensor for actuating the valve pin is further provided. An outer sleeve in which the valve sleeve is guided, wherein the valve sleeve can be displaced relative to the outer sleeve in accordance with a pressure in a safety control chamber between a triggering position and a locked position. The switching surface is coupled to the trigger and/or to the placing sensor such that it is always located in a permanently specified switching position or switching surface position relative to the outer sleeve when both the trigger as well as the placing sensor are actuated. The switching surface is arranged in the switching position such that it displaces the valve pin into the actuated position when the valve sleeve is located in the triggering position, and such that it does not displace the valve pin into the actuated position when the valve sleeve is located in the locked position.

The compressed air nailer is used for driving in fastening means, such as nails, tacks or staples. To this end, the compressed air nailer may have a magazine for the fastening means, in each case a fastening means being supplied therefrom to a receiver of an outlet tool of the compressed air nailer.

Both the driving as well as the controlling of the compressed air nailer can be entirely pneumatic; a supply with electrical energy is therefore unnecessary. "Deaerating" always means that a connection is established to a depressurized space, in particular to external air. "Aerating" always means that a connection is established to a space that conducts compressed air.

The trigger can for example be realized in the form of a rocker switch or sliding switch. The placing sensor can be a mechanical component which protrudes over the front end of the outlet tool and is held in this position by a spring until the compressed air nailer is placed onto a workpiece. Then the placing sensor is displaced opposite the direction of the spring force and opposite the driving direction.

When triggering a driving process, a working piston of the compressed air nailer is subjected to compressed air. In this case, the working piston drives a driving tappet which is connected to the working piston. The driving tappet strikes a rear end of the fastening means in the receiver of the outlet tool and drives the fastening means into the workpiece.

In order to trigger a driving process, a control line must be aerated or deaerated. This is accomplished by a trigger valve that is actuated by displacing a valve pin relative to a valve sleeve. For its part, the valve sleeve is guided in an outer sleeve (generally arranged in a fixed position relative to a housing of the compressed air nailer) so that it can be displaced between a triggering position and a locked position. The position in which the valve sleeve is located relative to the outer sleeve depends on a pressure in a safety control chamber.

The safety control chamber thus offers the possibility of realizing a time-controlled behavior of the compressed air nailer. For example, the pressure in the safety control chamber can be controlled such that a given pressure threshold is exceeded or undershot after the expiration of a given time period that has passed since the last driving process and/or since the last actuation of the trigger.

In an embodiment, the valve pin is actuated by means of a switching surface which is coupled to the trigger and/or to the placing sensor. Different than with some compressed air nailers explained as an introduction to the prior art, this coupling does not require a complicated, possibly failure-prone mechanism, but is rather designed such that the switching surface is always located in a permanently specified switching position relative to the outer sleeve when both the trigger as well as the placing sensor are actuated. In particular, an actuation sequence of the trigger and placing sensor is irrelevant.

Whether or not a driving process is triggered accordingly does not depend on the enabling of the coupling between the trigger and placing sensor, but rather substantially only on the position of the valve sleeve relative to the outer sleeve. The switching surface is always located in the switched position when the trigger and placing sensor are jointly actuated. If the valve sleeve is then located in the triggering position, the switching surface displaces the valve pin into the actuated position. If the valve sleeve is contrastingly located in the locked position, the switching surface does not displace the valve pin into the actuated position. Overall, the compressed air nailer is thus distinguished by a particularly simple and robust design.

In one embodiment, the compressed air nailer has a safety control valve which is controlled by the trigger and controls aeration or deaeration of the safety control chamber. The pressure characteristic of the safety control chamber therefore directly depends on the actuation of the trigger.

In one embodiment, a connection between the safety control chamber and an aerated housing interior is blocked by the safety control valve when the trigger is actuated. In this case, the safety control chamber is permanently and indirectly aerated by the safety control valve when the trigger is not actuated. This aeration ends upon an actuation of the trigger.

In one embodiment, the safety control chamber is connected via a throttle to external air. When the safety control chamber is aerated, this leads to a continuous, slight air stream which in certain circumstances is associated with an audible noise. This operating noise can indicate to the user the operational readiness of the compressed air nailer. Once an inflow into the safety control chamber ends, in particular after an actuation of the safety control valve by the trigger, the pressure in the safety control chamber slowly decreases so that the valve sleeve enters the locked position and prevents further triggering when a pressure threshold in the safety control chamber is undershot. In certain circumstances, a user can discern by the decreasing operating noise that he must first again release the trigger before another driving process.

In one embodiment, the switching surface is formed on a rocker that has a fixed end and a free end, wherein the fixed end is rotatably mounted on the trigger and the free end is entrained by the placing sensor upon an actuation of the placing sensor. This embodiment is a proven way of coupling the switching surface to the trigger and the placing sensor. Independent of the actuation sequence, the switching surface is always brought into the same switching position when the trigger and placing sensor are actuated.

In one embodiment, the switching surface is formed on the placing sensor and has a fixed position relative to the placing sensor. In this version, the switching surface is only coupled to the placing sensor and not to the trigger. If the valve sleeve is located in the triggering position, the trigger valve is accordingly controlled by each actuation of the placing sensor. If the trigger is also located in an actuated position, a driving process is triggered.

In one embodiment, the safety control valve and the trigger valve are series-connected. This means that the safety control valve and the trigger valve must be simultaneously actuated for the desired aeration or deaeration of the control line. For example, an output of the trigger valve can be indirectly or directly connected to the control line, whereas an input of the trigger valve is connected to an output of the safety control valve. An input of the safety control valve can be connected to an aerated housing interior. In this case, there can be a fixed assignment such that the placing sensor acts directly on the trigger valve and the trigger acts directly on the safety control valve. A mechanical coupling of the trigger and placing sensor is unnecessary.

In one embodiment, the safety control chamber is aerated or deaerated by the trigger valve and a non-return valve when the valve pin is displaced relative to the valve sleeve into the actuated position. By means of this measure, a driving process "resets" the pressure in the safety control chamber at the same time as a driving process is triggered. Accordingly with each driving process, a defined initial situation is established with regard to the pressure in the safety control chamber. In particular, a given time window for the triggering of additional driving processes can be opened from this point in time on when the trigger is continuously actuated.

In one embodiment, the non-return valve is integrated into the valve sleeve. For example, the non-return valve can have an O-ring which is held in a peripheral groove in the valve sleeve and seals a radial bore in the valve sleeve arranged in the groove. A particularly compact design is achieved by integrating the non-return valve into the valve sleeve.

In one embodiment, the safety control chamber has an annular space that is delimited by two seals inserted between the outer sleeve and the valve sleeve which are spaced from each other in the axial direction and radial direction. This measure as well promotes a particularly compact design. Another advantage is that the volume of the safety control chamber remains uninfluenced by an actuation of the valve pin.

In one embodiment, there is a continuously aerated counterpressure chamber, wherein the pressure in the counterpressure chamber exerts a counterforce on the valve sleeve which is directed in the direction opposite the force exerted on the valve sleeve by the pressure in the safety control chamber. Alternatively and/or in addition, a spring can be used to exert a counterforce on the valve sleeve. The use of a continuously aerated counterpressure chamber is particularly advantageous because the force exerted by the pressure in the safety control chamber and the counterforce exerted by the pressure in the counterpressure chamber equally depend on the operating pressure of the compressed air nailer. This leads to a functioning of the safety mechanism that is largely independent of pressure fluctuations.

In one embodiment, the counterpressure chamber has an annular space that is delimited by two seals adjacent to the valve sleeve which are spaced from each other in the axial direction and radial direction. This also contributes to a particularly compact design. In addition, with this annular counterpressure chamber design, the valve pin can be easily guided to the outside through a middle opening in the counterpressure chamber.

BRIEF DESCRIPTION OF THE DRAWINGS

The invention is explained in greater detail below with reference to an exemplary embodiment shown in figures. In the figures.

DETAILED DESCRIPTION OF THE INVENTION

Figure 1:
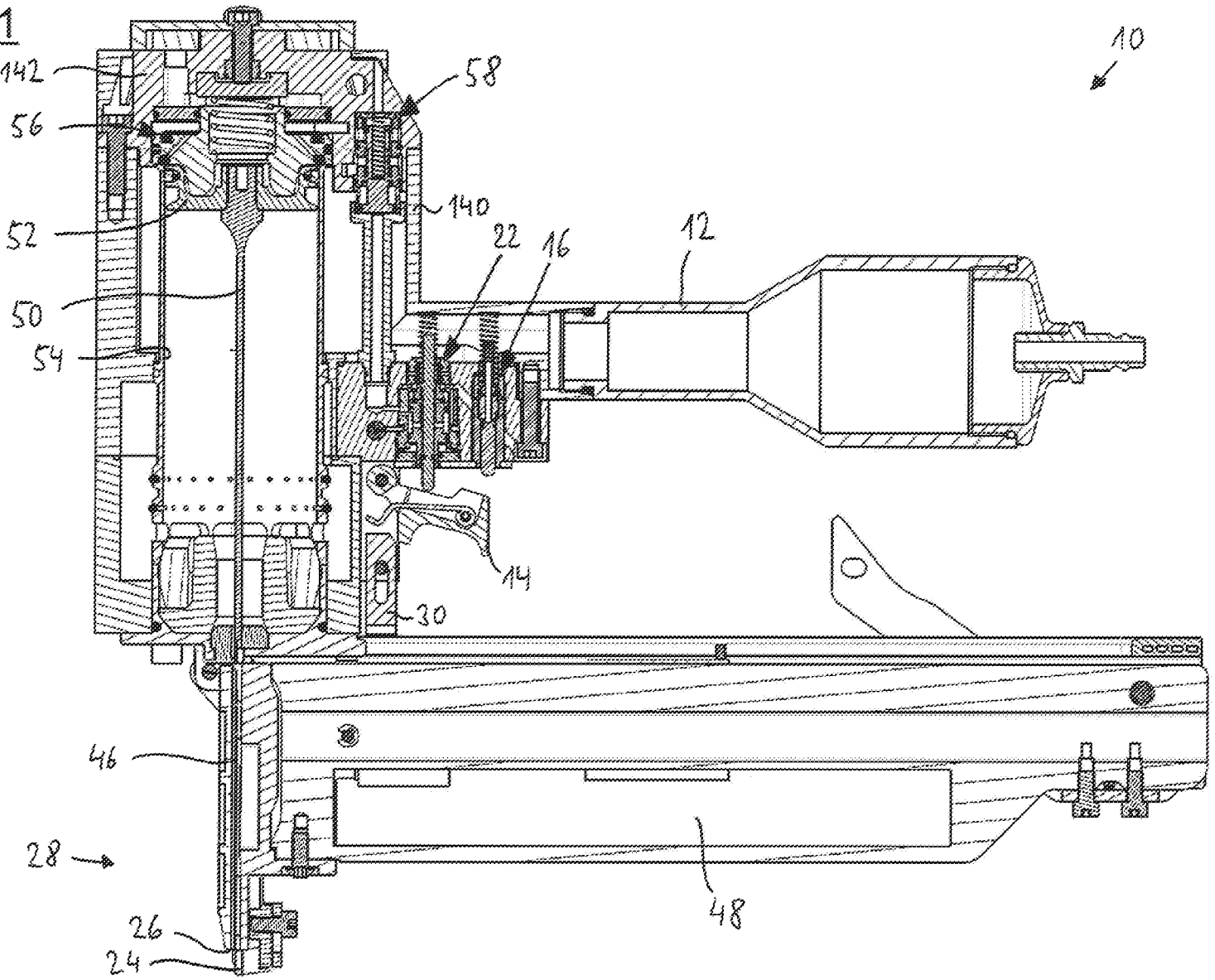
FIG. 1 illustrates a cross-sectional view of an embodiment of a compressed air nailer.

Initially, a few important elements of the compressed air nailer 10 will be described, some summarily, with reference to FIG. 1. The compressed air nailer 10 has a handle 12 that is attached to a lower housing part 140 which is closed at the top by a housing cap 142.

The compressed air nailer 10 has a placing sensor 24 that projects downward a few millimeters beyond the mouth 26 of an outlet tool 28. If the compressed air nailer 10 is placed onto a workpiece, the placing sensor 24 is displaced upward against the force of a spring (not shown) until it abuts the mouth 26 flush or projects just slightly above the mouth 26. The placing sensor 24 is mechanically coupled to a force transmission element 30 which also moves upward when the placing sensor 24 moves.

The outlet tool 28 has a receiver 46, in each case a fastening means being supplied thereto from a magazine 48. From this position inside the receiver 46, the fastening means, for example a nail, a tack or a staple, is driven in by a driving tappet 50 which is connected to a working piston 52 of the compressed air nailer 10. To this end, the working piston 52 is guided in a working cylinder 54. Above the working cylinder 54 and sealingly closing this working cylinder, a main valve 56 is arranged, to the right thereof being a pilot valve 58 which controls the main valve 56. Details of these elements as well as the associated function of the device will be explained with reference to the enlargement of a section in FIG. 2.

Figure 2:
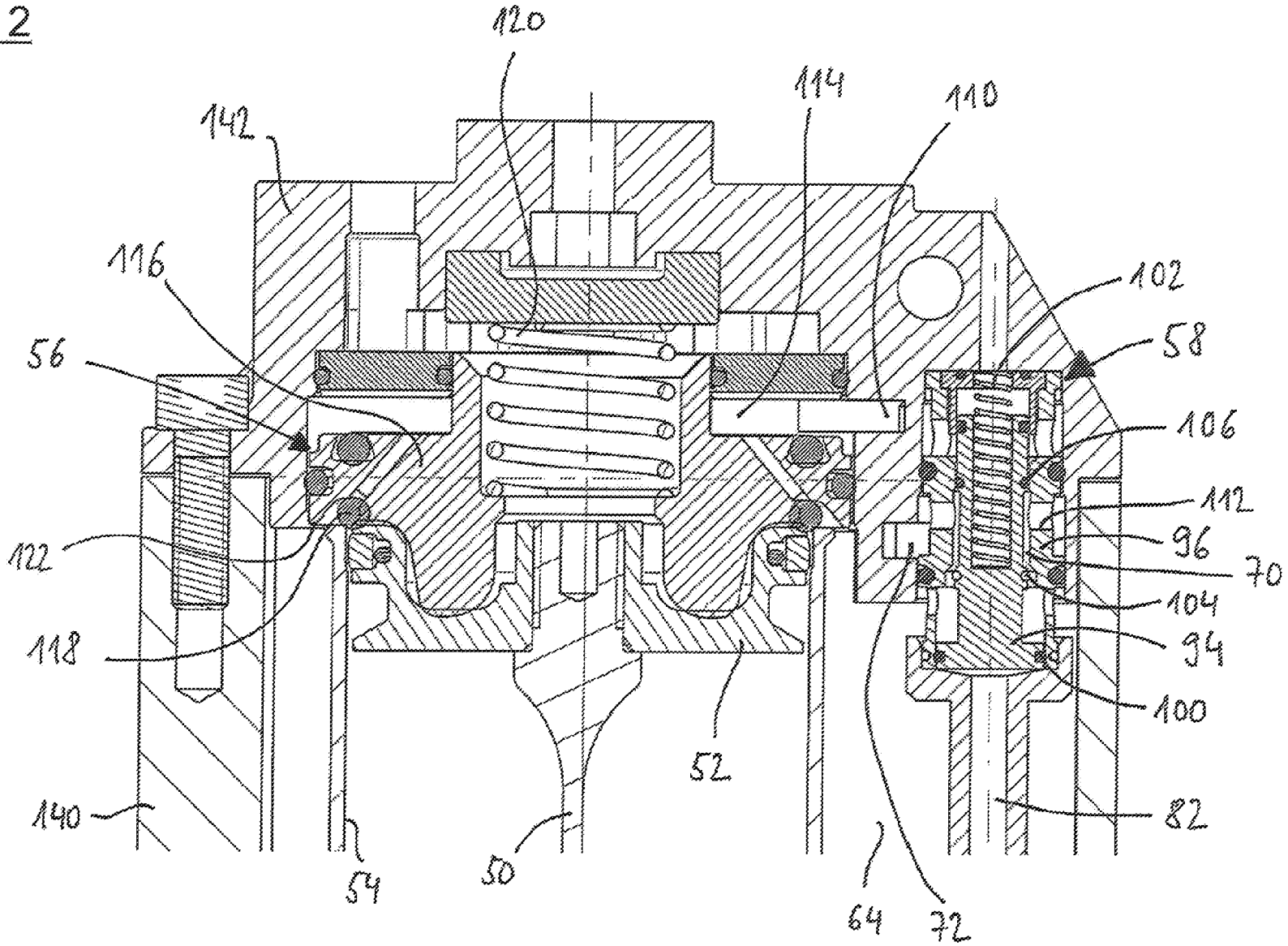
FIG. 2 illustrates an enlarged view of an embodiment of a main valve and a pilot valve of the embodiment of the compressed air nailer of FIG. 1.

The pilot valve 58 is best discernible in FIG. 2. It has a control piston 94 which is guided in a guide sleeve 96. The lower end of the control piston 94 is sealed by a lower O-ring 100 relative to the guide sleeve 96. In the initial state of the compressed air nailer 10, a first control line 82 which is connected to a working volume of the pilot valve 58 is deaerated, and the control piston 94 is located in the shown lower position. In this position, the control piston is retained by the force of a spring 102.

The control piston 94 has, in addition to the lower O-ring 100, a central O-ring 104 and an upper O-ring 106. In the depicted lower position of the control piston 94, the upper O-ring 106 seals the control piston 94 against the guide sleeve 96 and closes a connection to a deaeration opening (not shown) connected to the external air. The central O-ring 104 is not sealed, so that a main control line 110 is connected to the housing interior 64 via a radial bore 112 in the guide sleeve 96 and the annular gap 70 between the control piston 94 and guide sleeve 96 running past the central O-ring 104. The main control line 110 is connected via a connection, which is invisible in the depicted sectional plane, to the space 72 that terminates in the radial bore 112. The housing interior 64 in the initial state of the compressed air nailer 10 is aerated, i.e. connected to a compressed air connection, not shown, and at operating pressure.

The main control line 110 is connected to a space 114 above a main valve actuating member 116 of the main valve 56 such that the main valve actuating member 116 is subjected to a downward force which seals the upper edge of the working cylinder 54 by means of an O-ring 118 against the housing interior 64. Additionally, the main valve actuating member 116 is acted upon by a spring 120 with a force in the direction of the position shown, closing the working cylinder 54.

A driving process is triggered by aerating the control line 82 in that the control piston 94 is displaced upward so that the central O-ring 104 creates a seal and the upper O-ring 106 releases the seal. This blocks the connection of the main control line 110 to the housing interior 64, and a connection between the main control line 110 and a deaeration opening (not shown) is established. The space 114 above the main valve actuating member 116 is deaerated via the deaeration opening, and the main valve actuating member 116 is displaced upwardly counter to the force of the spring 120 by the pressure which is present on its lower outer annular surface 122 and which prevails in the housing interior 64. As a result, compressed air flows out of the housing interior 64 into the working cylinder 54 above the working piston 52 and drives the working piston 52 downwardly. With this downward movement, the driving tappet 50 connected to the working piston 52 drives in a fastening means.

As summarily discernible in FIG. 1, a triggering apparatus with a trigger valve 22, a safety control valve 16 and a trigger 14 is located below the pilot valve 58. Details of the triggering apparatus will be explained in greater detail with reference to FIGS. 3 to 7.

It can be seen in these figures that the trigger 14 is rotatably mounted about a pivot axis 18 in an easy-to-grip position on the housing of the compressed air nailer 10. The upper, rear end of the trigger 14 has a switching surface 20 which displaces a valve pin 32 of the safety control valve 16 upward upon an actuation of the trigger 14. This control of the safety control valve 16 occurs upon each actuation of the trigger 14 independent of the position of the placing sensor 24.

The force transmission element 30 of the placing sensor 24 is movably guided on the housing of the compressed air nailer 10 and to this end has a slot 34 through which a guide pin 36 is guided. Upon an actuation of the placing sensor 24, the force transmission element 30 is displaced upward from the starting position drawn in FIG. 3, and in so doing entrains the free end of a rocker 38, the fixed end of which is pivotably articulated about a pivot axis 41 in the interior of the trigger 14 and close to its free end. The rocker 38 is then arranged approximately parallel to a longitudinal direction of the trigger 14, and its upper side functions as a switching surface 40 which, given the joint actuation of the placing sensor 24 and the trigger 14, displaces a valve pin 42 of the trigger valve 22 upward and thus controls the trigger valve 22.

Figure 3:
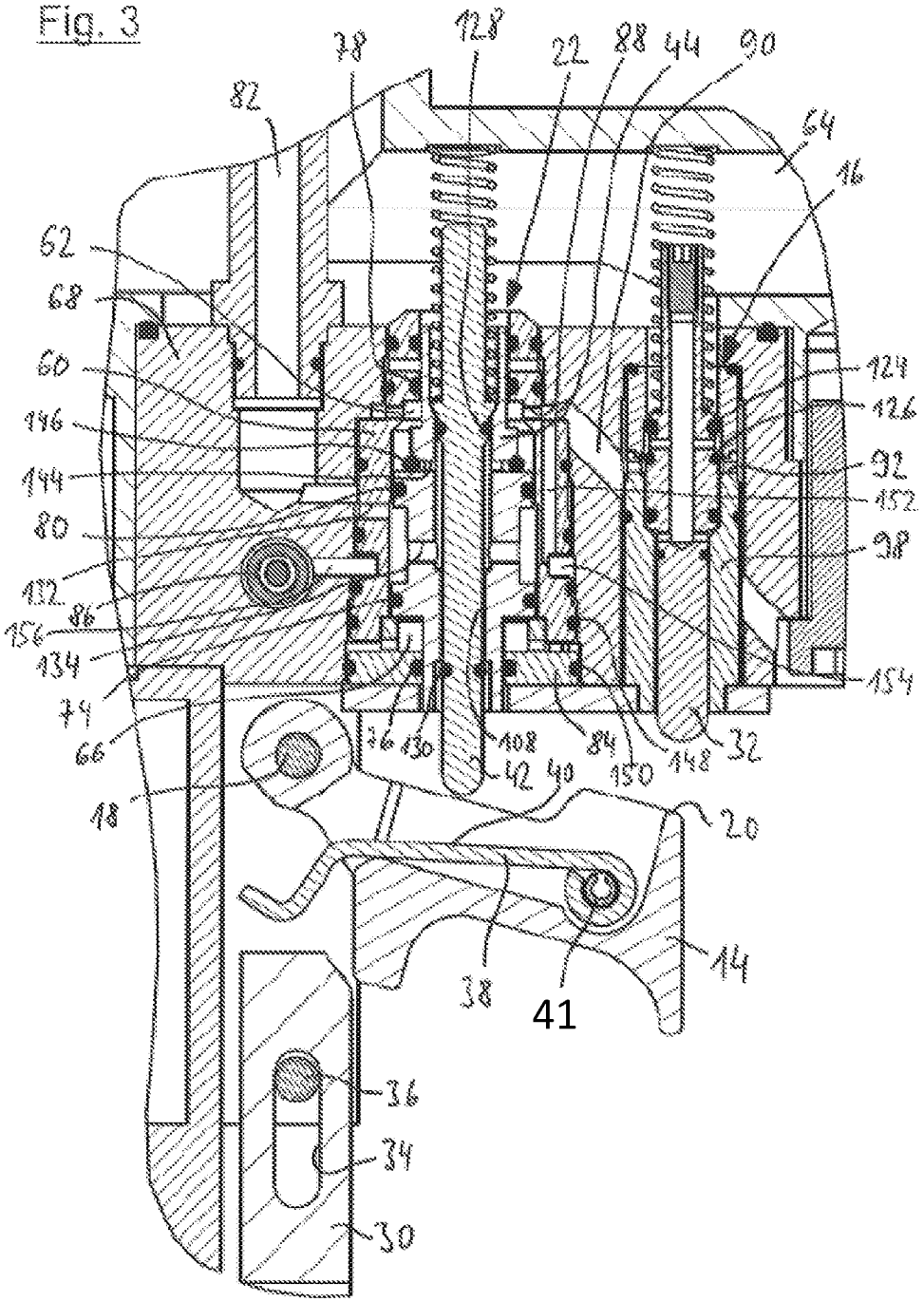
FIG. 3 illustrates an embodiment of a trigger, trigger valve, and a safety control valve of the air nailer of FIG. 1 in an operating state.

The trigger valve 22 has a valve sleeve 44 in which the valve pin 42 is guided. For its part, the valve sleeve 44 is guided in an outer sleeve 60 fixedly arranged relative to the handle 12. In FIG. 3, the valve sleeve 44 is located in a triggering position relative to the outer sleeve 60. In this triggering position that corresponds to an initial state of the compressed air nailer 10, the valve sleeve 44 is retained by pressure in a safety control chamber 62, which is aerated when the safety control valve 16 is not actuated. The force exerted on the valve sleeve 44 by the pressure in the safety control chamber 62 is greater than a counterforce exerted on the valve sleeve 44 by the pressure in the counterpressure chamber 66. The counterpressure chamber 66 is always connected to the housing interior 64 by a connection (not shown) and is therefore always aerated when the compressed air nailer 10 is connected to a compressed air supply.

The counterpressure chamber 66 surrounds a lower region of the valve sleeve 44 in a ring. It is delimited by an upper seal 74 and a lower seal 76 that produce a seal relative to the valve sleeve 44, wherein the upper seal 74 and lower seal 76 are spaced from each other in an axial direction and radial direction. The upper seal 74 is an O-ring inserted in a peripheral groove in the valve sleeve 44 which abuts the inside of the outer sleeve 60. The lower seal 76 is an O-ring inserted in a peripheral groove of a lock washer 84 which is inserted sealingly in a valve block 68 and abuts the outside of the valve sleeve 44. In a radial direction further to the outside, the counterpressure chamber 66 comprises a gap between the lock washer 84 and the outer sleeve 60. There, two additional seals 148 and 150 provide a seal of the counterpressure chamber 66 against the housing in which the outer sleeve 60 and lock washer 84 are inserted.

The safety control chamber 62 also has an annular space which is delimited by an upper seal 78 and lower seal 80. These two seals 78, 80 are also spaced from each other in a radial and axial direction and arranged between the valve sleeve 44 and the outer sleeve 60. The safety control chamber 62 is connected by an axial bore 152 in the outer sleeve 60, a ring gap 154 and a bore 156 in the housing to a throttle 86 through which a slight air stream continuously escapes when the safety control chamber 62 is aerated. Nonetheless, the operating pressure prevails in the safety control chamber 62 in the initial state shown in FIG. 3 since the safety control chamber 62 is simultaneously connected by a radial bore 88 in the outer sleeve 60 to a safety control line 90 which is connected to the housing interior 64 by the safety control valve 16. It is discernible in FIG. 3 that the two O-rings 124, 126 of the safety control valve 16 do not provide a seal so that the connection between the safety control line 90 and the housing interior 64 is opened via a radial bore 92 in a valve sleeve 98 of the safety control valve 16.

In the initial position of the trigger valve 22 shown in FIG. 3, the valve pin 42 is in an unactuated position relative to the valve sleeve 44 in which an upper O-ring 128 arranged on the valve pin 42 provides a seal, and a lower O-ring 130 arranged on the valve pin 42 does not provide a seal. Consequently, the control line 82 is connected to external air by a radial bore 132 in the outer sleeve 60, a radial bore 134 in the valve sleeve 44, and an annular gap 108 between the valve pin 42 and valve sleeve 44.

The valve sleeve 44 has another radial bore 144 that is sealed by an O-ring 146 arranged in a groove running around the outside of the valve sleeve 44. This arrangement with the O-ring 146 forms a non-return valve by means of which the safety control chamber 62 can be aerated by the trigger valve 22.

Figure 4:
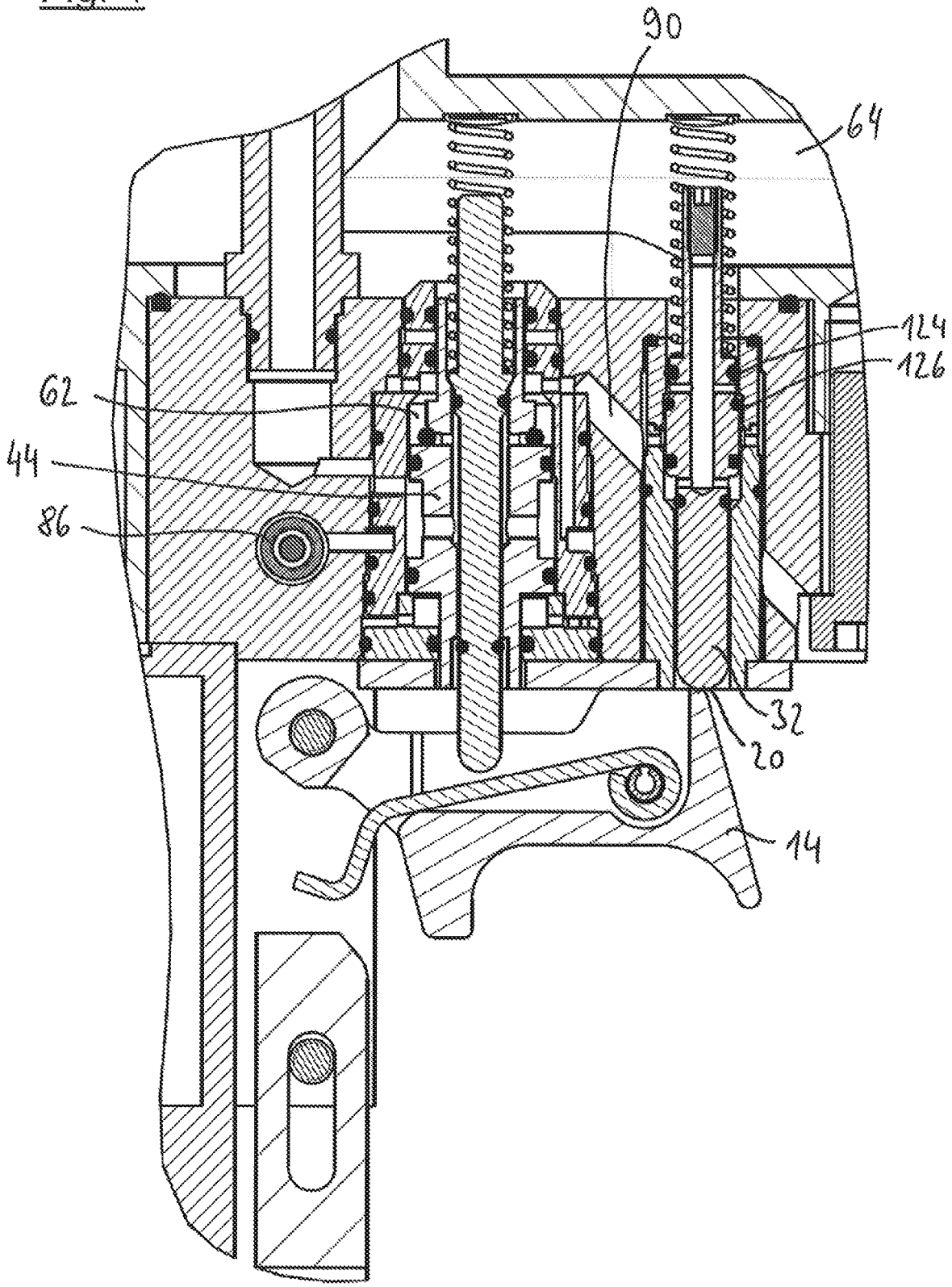
FIG. 4 illustrates the embodiment of a trigger, trigger valve, and a safety control valve of the air nailer of FIG. 1 in another operating state.

Starting from the initial state from FIG. 3, if the trigger 14 is actuated, the arrangement shown in FIG. 4 results. The switching surface 20 of the trigger 14 has displaced the valve pin 32 upward and thereby actuated the safety control valve 16. The two O-rings 124 and 126 now provide a seal so that the connection of the safety control line 90 to the housing interior 64 is blocked. Consequently, the pressure in the safety control chamber 62 gradually decreases via the throttle 86. Until a given pressure threshold in the safety control chambers 62 is undershot, the valve sleeve 44 remains in its triggering position.

Figure 5:
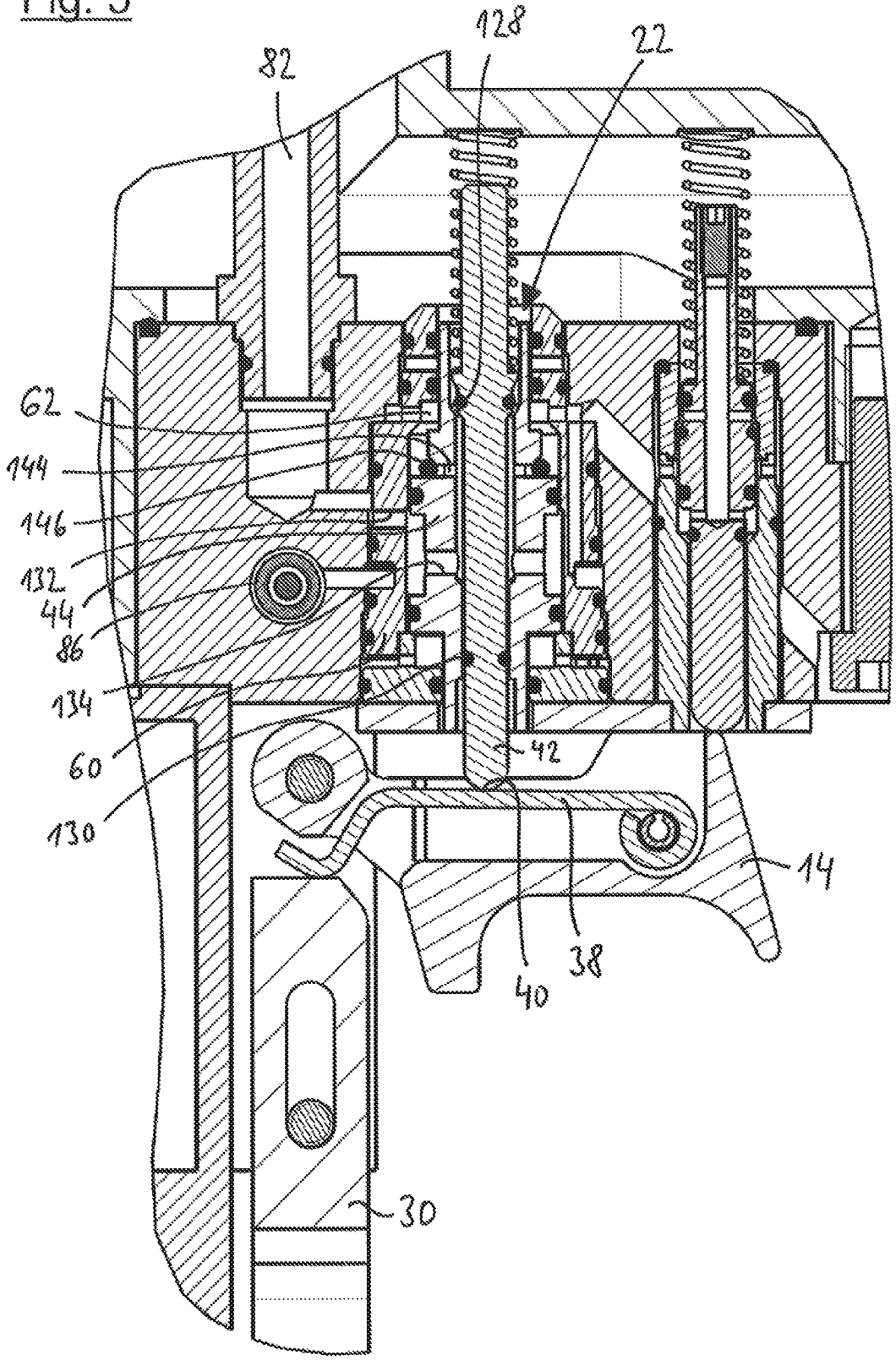
FIG. 5 illustrates the embodiment of a trigger, trigger valve, and a safety control valve of the air nailer of FIG. 1 in another operating state.

If the compressed air nailer 10 is now placed onto a workpiece, the arrangement portrayed in FIG. 5 results, and the following occurs: The placing sensor 24 is actuated, and the force transmission element 30 of the placing sensor 24 entrains the free end of the rocker 38 on its path upward so that the switching surface 40 formed on the upper side of the rocker 38 reaches its switching position, which is always arranged in the same position relative to the outer sleeve 60 and is always set when both the trigger 14 as well as the placing sensor 24 are actuated. The valve pin 42 of the trigger valve 22 is displaced into its actuated position relative to the valve sleeve 44. This moves the lower O-ring 130 into a seal, whereas the upper O-ring 128 moves out of the seal. Compressed air from the housing interior 64 flows past the upper O-ring 128 through the radial bore 134 in the valve sleeve 44 and through the radial bore 132 in the outer sleeve 60 into the control line 82, which triggers a driving process. At the same time, the pressure in the safety control chamber 62 is refreshed by the air flowing past the upper O-ring 128 through the non-return valve formed by the other radial bore 144 and the O-ring 146.

Figure 6:
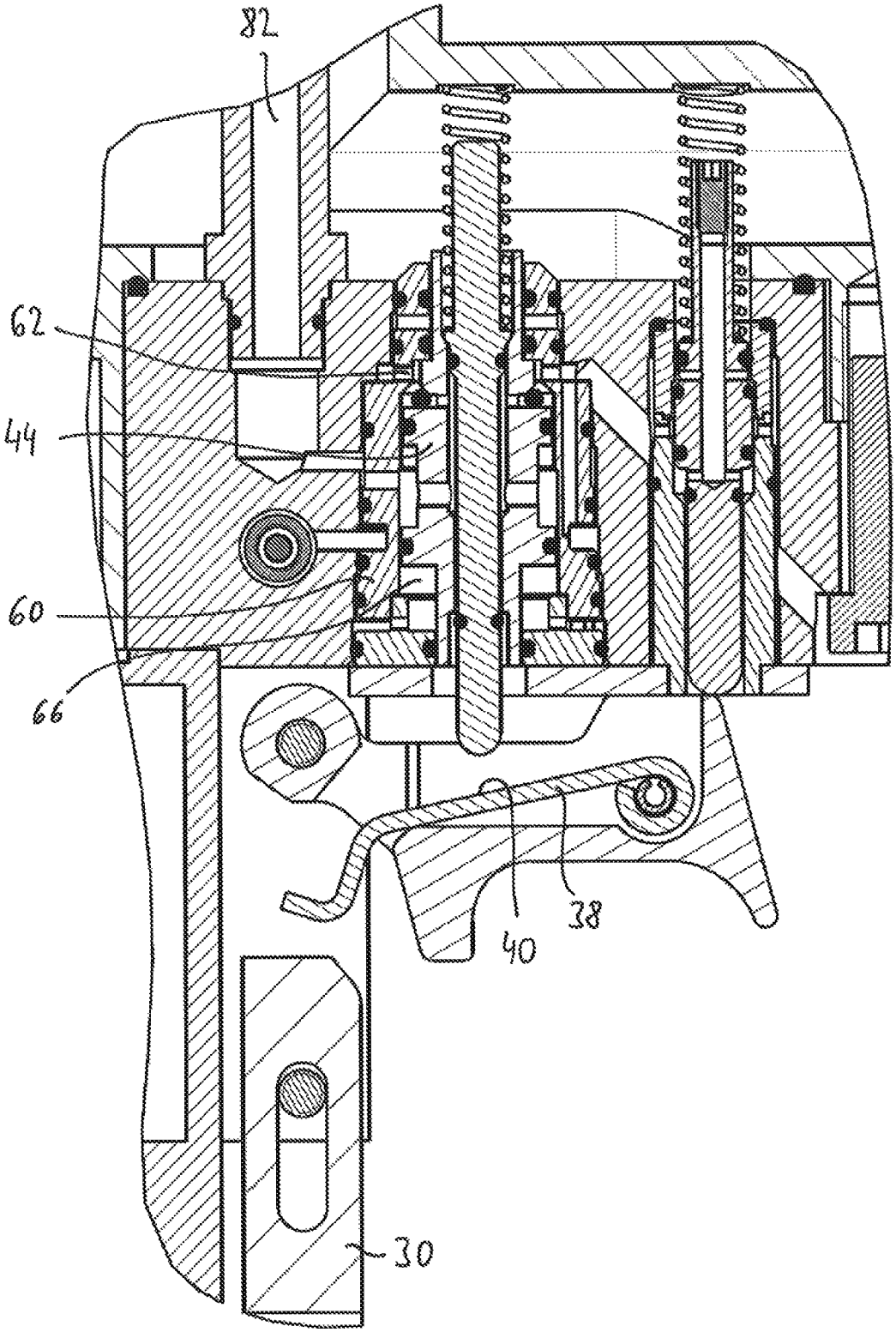
FIG. 6 illustrates the embodiment of a trigger, trigger valve, and a safety control valve of the air nailer of FIG. 1 in another operating state.
Figure 7:
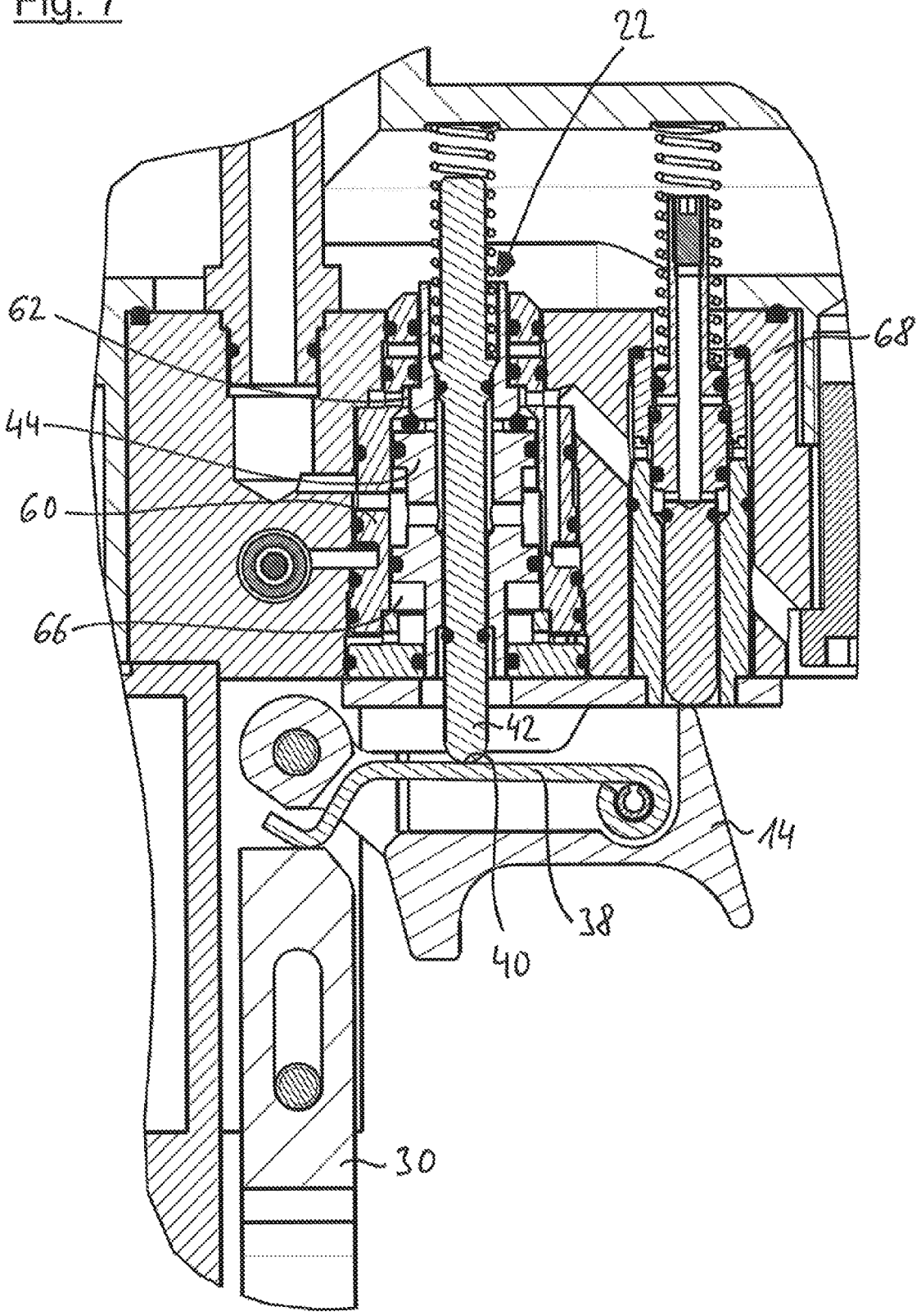
FIG. 7 illustrates the embodiment of a trigger, trigger valve, and a safety control valve of the air nailer of FIG. 1 in still another operating state.

If, after the trigger 14 is actuated corresponding to FIG. 4, the placing sensor 44 is not actuated for a time period of e.g. four seconds or longer, and the pressure in the safety control chamber 62 consequently drops below a given pressure threshold, the valve sleeve 44 is displaced relative to the outer sleeve 60 into its locked position shown in FIG. 6. In this case, the control line 82 remains still connected to external air by the path explained with reference to FIG. 3.

If, starting from this situation, the placing sensor 24 is actuated, the rocker 38 and the switching surface 40 along with it also reach their switching position precisely as explained with reference to FIG. 5. However, this does not cause a driving process to be triggered because the valve sleeve 44 is in its locked position relative to the outer sleeve 60, i.e., withdrawn into the interior of the handle 12, or respectively the valve block 68 in comparison to its triggering position in the direction of actuation of the valve pin 42. Consequently, the switching surface 40 cannot actuate the trigger valve 22 despite reaching its switching position. Another driving process can only be triggered when the trigger 14 has been released for a short time which leads to an aeration of the safety control chamber 62 and hence a displacement of the valve sleeve 44 into its triggering position.

LIST OF REFERENCE NUMBERS USED

10 Compressed air nailer
12 Handle
14 Trigger
16 Safety control valve
18 Pivot axis
20 Switching surface
22 Trigger valve
24 placing sensor
26 Mouth
28 Outlet tool
30 Force transmission element
32 Valve pin of the safety control valve
34 Slot
36 Guide pin
38 Rocker
40 Switching surface
41 Pivot axis
42 Valve pin
44 Valve sleeve
46 Receiver
48 Magazine
50 Driving tappet
52 Working piston
54 Working cylinder
56 Main valve
58 Pilot valve
60 Outer sleeve
62 Safety control chamber
64 Housing interior
66 Counterpressure chamber
68 Valve block
70 Annular gap
72 Space
74 Upper seal
76 Lower seal
78 Upper seal
80 Lower seal
82 Control line
84 Lock washer
86 Throttle
88 Radial bore in the outer sleeve
90 Safety control valve
92 Radial bore
94 Control piston
96 Guide sleeve
98 Valve sleeve
100 Lower O-ring
102 Spring
104 Central O-ring
106 Upper O-ring
108 Annular gap
110 Main control line
112 Radial bore
114 Space
116 Main valve actuating member
118 O-ring
120 Spring
122 Annular surface
124 O-ring of the safety control valve
126 O-ring of the safety control valve
128 Upper O-ring of the trigger valve
130 Lower O-ring of the trigger valve
132 Radial bore in the outer sleeve
134 Radial bore in the valve sleeve
140 Lower housing part
142 Housing cap
144 Additional radial bore of the valve sleeve
146 O-ring
148 Additional seal
150 Additional seal
152 Bore
154 Annular gap
156 Bore

The invention claimed is:

1. A compressed air nailer comprising:

a working piston;

a driving tappet coupled to the working piston and configured for driving in a fastening means during a driving process, wherein compressed air is applied when the driving process is triggered;

a trigger valve comprising a valve sleeve and a valve pin configured to be guided within the valve sleeve;

a control line configured to be one of aerated and deaerated by the trigger valve, wherein the one of aeration and deaeration of the control line is configured to trigger the driving process when the valve pin is displaced relative to the valve sleeve into an actuated position;

a trigger;

a placing sensor;

a switching surface coupled to at least one of the trigger and the placing sensor, the switching surface configured to actuate the valve pin;

an outer sleeve configured to at least partially surround and guide the valve sleeve;

a safety control chamber, wherein a pressure within the safety control chamber is configured to displace the valve sleeve relative to the outer sleeve between a triggering position and a locked position; and a safety control valve configured to be controlled by the trigger, wherein the safety control valve controls the one of the aeration and deaeration of the safety control chamber, wherein, when the switching surface is located in a switching surface position relative to the outer sleeve, actuation of both the trigger and the placing sensor result in displacement of the switching surface, wherein the switching surface is positioned in the switching surface position such that the switching surface displaces the valve pin into the actuated position when the valve sleeve is positioned in the triggering position, and wherein the switching surface does not displace the valve pin into the actuated position when the valve sleeve is positioned in the locked position, wherein when the trigger is actuated, the trigger contacts and displaces the safety control valve such that a connection between the safety control chamber and an aerated housing interior is blocked by the safety control valve.

2. The compressed air nailer according to claim 1, wherein the safety control chamber is connected via a throttle to external air.

3. The compressed air nailer according to claim 2, wherein the switching surface is formed on a rocker that includes a fixed end and a free end, wherein the fixed end is rotatably mounted on the trigger, and wherein the free end is entrained by the placing sensor upon an actuation of the placing sensor.

4. The compressed air nailer according to claim 2, wherein the switching surface is formed on the placing sensor and is at a fixed position relative to the placing sensor.

5. The compressed air nailer according to claim 4, wherein the safety control valve and the trigger valve are series-connected.

6. The compressed air nailer according to claim 5, wherein the safety control chamber is at least one of aerated and deaerated by the trigger valve and a non-return valve when the valve pin is displaced relative to the valve sleeve into the actuated position.

7. The compressed air nailer according to claim 6, wherein the non-return valve is integrated into the valve sleeve.

8. The compressed air nailer according to claim 1, wherein the safety control chamber defines an annular space that is delimited by two seals positioned between the outer sleeve and the valve sleeve, and wherein the two seals are spaced apart from each other in an axial direction and a radial direction.

9. The compressed air nailer according to claim 1, further comprising a counterpressure chamber that is continuously aerated, wherein a pressure inside the counterpressure chamber exerts a counterforce on the valve sleeve in a direction opposite a force exerted on the valve sleeve by the pressure in the safety control chamber.

10. The compressed air nailer according to claim 9, wherein the counterpressure chamber defines an annular space that is delimited by two seals abutting the valve sleeve, and wherein the two seals are spaced from each other in an axial direction and a radial direction.

* * * * *